United States Patent [19]

Kubiatowicz

[11] Patent Number: 4,496,329

[45] Date of Patent: Jan. 29, 1985

[54] WATER JET TOY

[75] Inventor: James F. Kubiatowicz, Fridley, Minn.

[73] Assignee: Custom Concepts, Incorporated, Minneapolis, Minn.

[21] Appl. No.: 489,710

[22] Filed: Apr. 29, 1983

[51] Int. Cl.[3] ..... A63H 29/10

[52] U.S. Cl. ..... 446/167; 446/267

[58] Field of Search ..... 46/41, 44, 91, 95; 239/20, 211, 289, 505; 273/1 L, 349

[56] References Cited

U.S. PATENT DOCUMENTS

| | | | |
|---|---|---|---|
| 755,114 | 3/1904 | Damm | 239/20 |
| 1,854,613 | 4/1932 | Ishikawa | 239/505 |
| 2,118,609 | 5/1938 | Klug | 46/44 |
| 4,205,785 | 6/1980 | Stanley | 239/211 |
| 4,223,471 | 9/1980 | Greenberg | 46/91 |

*Primary Examiner*—Robert A. Hafer
*Assistant Examiner*—Daniel Nolan
*Attorney, Agent, or Firm*—William L. Huebsch

[57] ABSTRACT

A toy adapted to be activated by water from a garden hose. A nozzle assembly at the bottom of a bowl directs water into and agitates water in the bowl while directing a jet of water vertically upwardly from within the bowl. Balls floating on the agitated water are randomly drawn by the jet into the inlet end of a tube supported above the water level around the jet, and are then propelled upwardly through the tube by the jet so that they will amuse or can be caught by children playing under the water jet.

6 Claims, 2 Drawing Figures

WATER JET TOY

TECHNICAL FIELD

The present invention relates to toys adapted to be activated by water from a garden hose which produce a vertical water jet that can be played around by children.

BACKGROUND ART

Toys are known which are adapted to be activated by water under pressure from a garden hose and which produce a vertical water jet that can be played around by children. In one such toy, a conical member is supported by the water jet so that it will amuse and can be snatched from off the jet as a form of game for children playing around the jet.

DISCLOSURE OF INVENTION

The present invention provides a toy adapted to be activated by water from a garden hose that forms a vertically upward projecting jet around which children can play and which randomly propels generally spherical objects, such as colored Ping-Pong balls, upwardly with the jet to amuse and/or to afford a game among the children in which they attempt to catch the objects in flight.

The water-activated toy according to the present invention comprises a bowl adapted to contain water, and a water-distribution assembly at the bottom of the bowl adapted to be coupled to a source of water under pressure from a garden hose. The water-distribution assembly includes means for directing water into the bowl, for agitating water within the bowl, and for forming and directing a jet of water along a path vertically upwardly from within the bowl. Means are provided for maintaining water at a predetermined level within the bowl slightly above the beginning of the jet, and a plurality of light, buoyant generally spherical objects are adapted to float on the agitated water at that level. A tube with an inside diameter slightly larger than the diameters of the objects is supported with its axis vertically oriented coaxially with the path for the water jet and its inlet end sufficiently above the water level (i.e., by a distance slightly exceeding the diameter dimensions of the objects or the dimensions between the water surface and the tops of the floating objects) that the movement of agitated water toward the jet of water will randomly bring one of the objects into contact with the jet which can then draw the object into the inlet end of the tube. The jet will then propel the object upwardly through the tube. Children (or other persons) playing around the jet can then compete to catch the objects.

BRIEF DESCRIPTION OF DRAWING

The present invention will be further described with reference to the accompanying drawing wherein like numbers refer to like parts in the several views, and wherein.

DESCRIPTION OF PREFERRED EMBODIMENT

Figure 1:
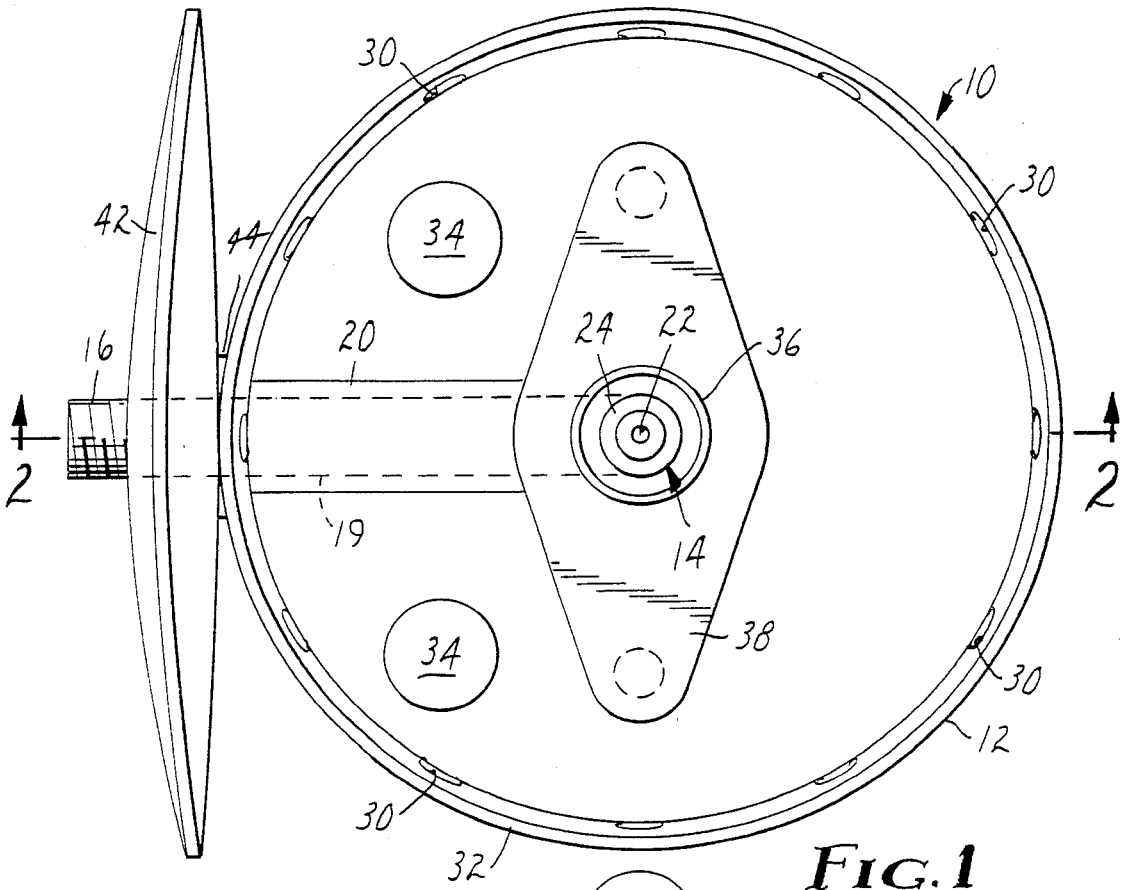
FIG. 1 is a top plan view of a water-activated toy according to the present invention having a cover broken away to show details.
Figure 2:
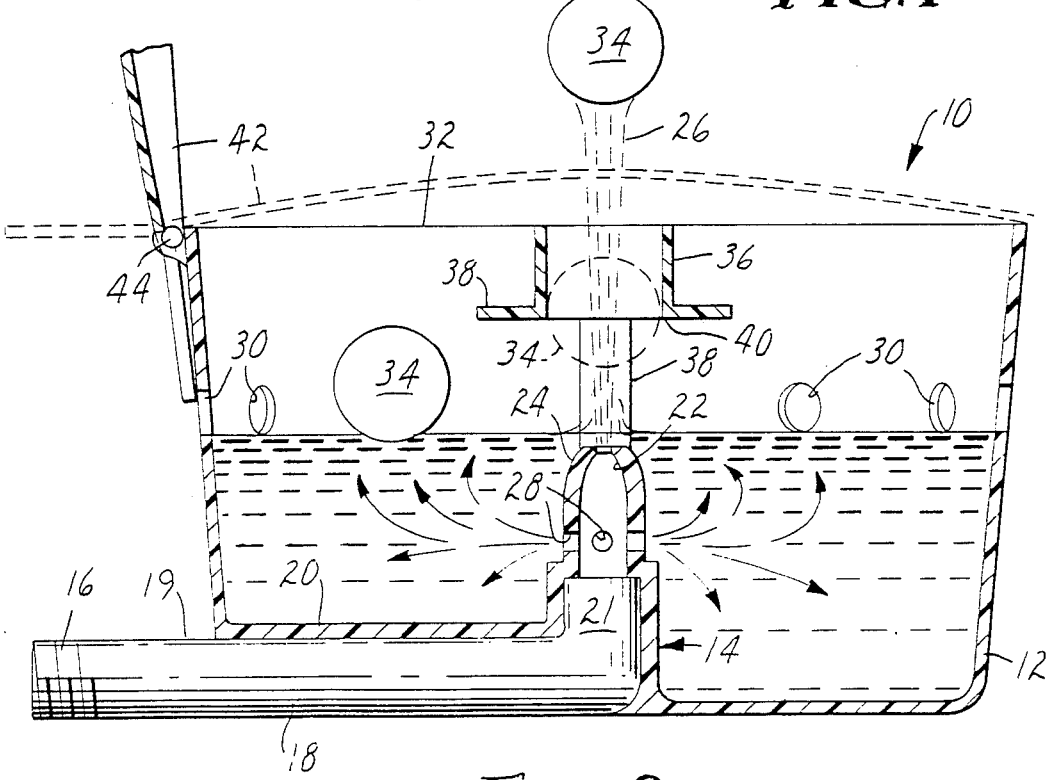
FIG. 2 is a sectional view taken approximately along line 2—2 of FIG. 1.

Referring now to FIGS. 1 and 2 of the drawing there is shown a water-activated toy according to the present invention, generally designated by the reference numeral 10.

The toy 10 comprises a bowl 12 adapted to contain water, and a water-distribution assembly 14 at the bottom of the bowl 12 adapted to be coupled to a source of water under pressure from a garden hose at a hose coupling 16. The distribution assembly 14 includes a pipe 18 including a horizontal straight portion 19 connected at one end to the coupling 16 and extending along a bottom surface of the bowl 12 in a recess defined by a channel-like portion 20 of the bottom wall of the bowl 12, and an upwardly projecting outlet portion 21 disposed at 90 degrees to the straight portion 19 fixed, as by an adhesive, within a central cylindrical outer surface portion on the bottom wall of the bowl 12. An opening through the pipe 18 communicates with a vertically extending passageway 22 through a nozzle 24 formed centrally in the bottom wall of the bowl 12. The nozzle 24 and vertical passageway 22 provide means for forming and directing a jet 26 of water along a path vertically upwardly from within the bowl 12. The nozzle 24 also has a plurality of generally horizontally oriented through outlet passageways 28 communicating with and extending radially outwardly at 90-degree intervals around the vertical passageway 22 to provide means for directing water into the bowl 12 and for agitating water within the bowl 12.

Means in the form of spaced openings 30 through the wall of the bowl 12 at a uniform distance below its rim 32 are provided for maintaining water at a predetermined level within the bowl 12, which predetermined level will be slightly (e.g., $\frac{1}{8}$ to $\frac{1}{4}$ inch) above the upper end of the nozzle 24 and thus above the bottom end of the jet 26. A plurality of light, buoyant spherical objects or balls 34 (i.e., colored Ping-Pong balls) are positioned within the bowl 12 and will float on the agitated water at the predetermined level. A short cylindrical tube 36 with an inside diameter slightly larger than the diameter of the balls 34 is supported by an inverted U-shaped structure 38 projecting from the bottom of the bowl 12 with an inlet end 40 of the tube 36 above the predetermined water level a distance slightly exceeding the diameter of the balls 34 and with the axis of the tube 36 vertically oriented coaxially with the vertical passageway 22 of the nozzle 24 and thus with the water jet 26 produced thereby.

The agitation of the water within the bowl 12 will randomly bring one of the balls 34 into contact with water being drawn to the center of the bowl 12 by the vertical water jet 26 from the submerged nozzle 24 generally in the manner of a jet pump. The jet 26 will then draw that ball 34 to and move it into the inlet end 40 of the tube 36, whereupon the jet 26 will propel the ball 34 upwardly through the tube 36 and into the air with the water jet 26. Children of any age playing around the toy will thus be amused and may compete to catch the ball 34 in flight. The horizontal outlet passageways 28 both provide agitation which keeps balls 34 within the bowl 12 from staying against the outer wall of the bowl 12 away from the influence of water moving toward the jet 26; and maintain water within the bowl 12 at its predetermined level by replacing water that is drawn out of the bowl 12 by the jet 26.

As illustrated, the toy 10 has a cover 42 pivotably mounted by a hinge 44 at one edge of the bowl for pivotal movement from a closed position over the bowl 12 (shown in dotted outline in FIG. 2) to an open position projecting vertically upwardly at one edge of the bowl 12 out of the way of the vertical jet 26 of water produced by the activated toy 10. The cover 42 could include a counterweight (not shown) projecting outwardly of the edge of the bowl 12, which counterweight could be adapted to afford positioning of the cover in its closed position, but which could help cause movement of the cover to its open position after the cover is started away from its closed position by the force of the water jet 26. Alternately, as shown, the cover 42 can be adapted to be manually opened before the toy 10 is activated.

The water-activated toy has now been described with reference to one embodiment thereof. It will be appreciated that many changes and/or additions (in addition to the counterweight described above) to that embodiment could be made without departing from the scope of the present invention. For example, the toy 10 is operable, although not as predictably, without the four horizontal outlet passageways 28 in the nozzle 24, since the water in the bowl will be agitated by the jet of water starting from under the predetermined level of water in the bowl and by water falling back into the bowl from the jet, and such falling water can also be directed into the bowl. The bowl 12 and cover 42 may be given generally the appearance of a clam which is opened to allow the toy to operate. Alternatively the tube can be formed or supported on and extend through the cover, and the cover can be supported in a normal manner on the rim of the bowl with the inlet end of the tube supported the appropriate distance above the water level so that the toy can then be operated with the cover closed. Such an embodiment could, for example, have the cover shaped generally like the head of an elephant with his trunk (the tube) projecting vertically upwardly. Thus the scope of the present invention should not be limited to the structure shown in the drawing, but should include all structures described by the claims and their equivalents.

I claim:

1. A water-activated toy comprising:

a bowl adapted for containing water;

a water-distribution assembly at the bottom of said bowl adapted to be coupled to a source of water under pressure, said assembly including means for directing water into said bowl, for agitating water within said bowl, and for forming and directing a jet of water along a path vertically upwardly from within said bowl;

means for maintaining water at a predetermined level within said bowl slightly above the beginning of said jet of water;

a plurality of light, buoyant generally spherical objects having similar diameter dimensions adapted to float on the agitated water within said bowl;

a tube having an axis, an inlet end, and an inside diameter slightly larger than said object diameter; and means for supporting said tube on said bowl with said axis vertically oriented coaxial with said path and said inlet end sufficiently above said predetermined level that an object on agitated water within said bowl that is moved into contact with the jet of water can be drawn into said inlet end and projected through said tube by said jet.

2. A water-activated toy according to claim 1 wherein said means for maintaining water at a predetermined level within the bowl comprises a plurality of through openings spaced around said bowl.

3. A water-activated toy according to claim 1 wherein said light buoyant objects are spherical.

4. A water-activated toy according to claim 1 wherein said toy further comprises a cover mounted at one edge of said bowl for pivotal movement from a closed position over said bowl to an open position spaced to one side of said bowl.

5. A water-activated toy according to claim 1 wherein said water-distributing assembly includes a nozzle generally centrally located within said bowl, said nozzle assembly having a central vertically oriented outlet passageway to provide said means for forming and directing said jet, and a plurality of generally horizontally oriented outlet passageways extending radially outwardly around said outlet passageway to provide said means for directing water into said bowl and for agitating water within said bowl.

6. A water-activated toy according to claim 1 wherein said means for supporting said tube comprises a generally inverted U-shaped support structure projecting upwardly from the bottom of said bowl.

* * * * *